United States Patent [19]

Theobald et al.

[11] Patent Number: 4,575,728

[45] Date of Patent: Mar. 11, 1986

[54] DIPOLE ARRAY WITH MEANS FOR COMPENSATING FEEDLINE PARASITIC CURRENTS

[75] Inventors: Michael Theobald, Ditzingen; Gerhard Greving, Untergruppenbach, both of Fed. Rep. of Germany

[73] Assignee: International Standard Electric Corporation, New York, N.Y.

[21] Appl. No.: 472,405

[22] Filed: Mar. 4, 1983

[30] Foreign Application Priority Data

Mar. 11, 1982 [DE] Fed. Rep. of Germany ..... 3208789

[51] Int. Cl.[4] ..... H01Q 21/10

[52] U.S. Cl. ..... 343/813; 343/815

[58] Field of Search ..... 343/814–819, 343/795, 797, 700 MS File, 810–813, 824, 827, 907, 908

[56] References Cited

U.S. PATENT DOCUMENTS

| | | | |
|---|---|---|---|
| 3,541,559 | 11/1970 | Evans | 343/795 |
| 3,681,769 | 8/1972 | Perrotti et al. | 343/814 |
| 3,750,185 | 7/1973 | Evans | 343/814 |
| 3,887,925 | 6/1975 | Ranghelli et al. | 343/814 |
| 4,097,868 | 6/1978 | Borowick | 343/817 |
| 4,514,734 | 4/1985 | Cermignani | 343/708 |

FOREIGN PATENT DOCUMENTS

| | | | |
|---|---|---|---|
| 1398262 | 6/1975 | United Kingdom | 343/815 |

*Primary Examiner*—Eli Lieberman
*Assistant Examiner*—Michael C. Wimer
*Attorney, Agent, or Firm*—John T. O'Halloran; Peter R. Ruzek

[57] ABSTRACT

A vertical dipole array (2, 3 to $2^{(n)}$, $3^{(n)}$) is formed on a substrate (1) using stripline techniques. The dipoles are supplied with RF energy from a feed system consisting of stripline conductors (4, 4', 5, 6, 7, 7', 9, 12). By a parasitic compensating radiator (11) provided opposite these conductors on the same side of the substrate, the influence of the conductors on the radiation pattern of the dipoles is largely compensated for.

The conductors of the feed system are arranged so that a combination of a parallel feed and an equal line length series feed (or, if the radiation pattern is to be raised, a series feed with suitably chosen line lengths) is obtained.

4 Claims, 1 Drawing Figure

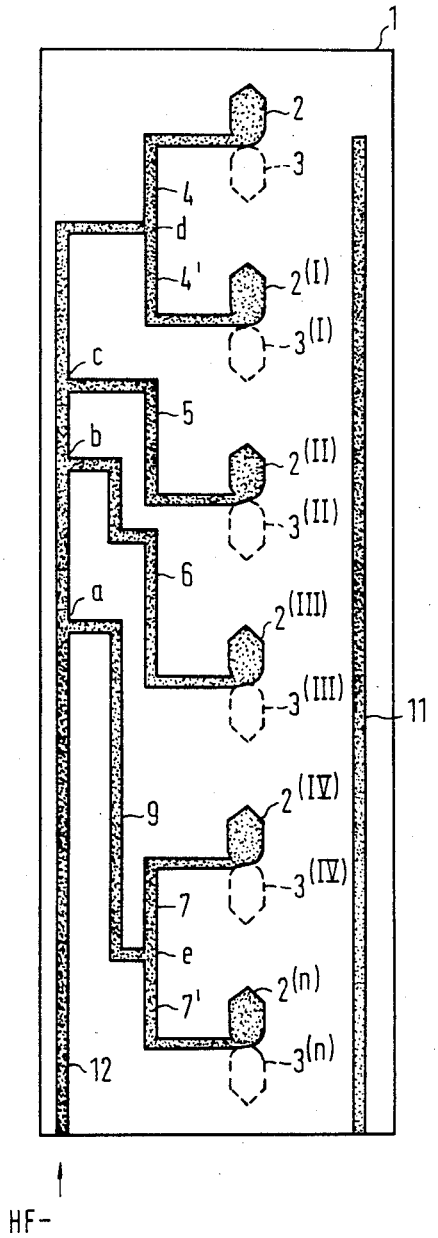
1
2
3
4
d
4'
2(I)
3(I)
c
5
b
2(II)
3(II)
6
a
2(III)
3(III)
11
2(IV)
9
3(IV)
7
e
2(n)
7'
3(n)
12
HF-

DIPOLE ARRAY WITH MEANS FOR COMPENSATING FEEDLINE PARASITIC CURRENTS

BACKGROUND OF THE INVENTION

The present invention relates to an antenna with at least one dipole wherein the dipole and the feed system for the dipole are realized during stripline techniques. An antenna of this kind is disclosed in an article by A. E. Holley, "An Electronically Scanned Beacon Antenna", IEEE Transactions on Antennas and Propagation, Vol. AP-22, No. 1, January 1974, pages 3 to 12 (particularly page 10).

Stripline antennas are inexpensive to manufacture and easily reproducible. However, conventional stripline antennas with dipoles cannot be used as omnidirectional radiators because the parasitic currents produced on the feed system for the dipoles deform the circular radiation pattern produced by the dipoles.

Conventional omnidirectional antennas are generally realized using coaxial-line techniques. If such an antenna contains several dipoles arranged one above the other in the vertical direction, the individual dipoles are center-fed. The manufacturing costs are relatively high.

The object of the invention is to provide a stripline omnidirectional antenna.

SUMMARY OF THE INVENTION

The above object is attained by providing a parasitic compensating radiator at the plane of the antenna dipole and the feeding means therefor, this radiator serving to compensate for the distortion of the radiation pattern of the dipole that is caused by the flow of electric current through the feeding means.

The novel antenna has a good omnidirectional characteristic (±1 dB) and a large bandwidth (±5% at 1 GHz). In a preferred embodiment in which two or more dipoles are arranged one above the other, high directivity in the vertical direction is achieved. In another embodiment, the feed system is designed to occupy only little space on the substrate on which the dipoles are formed. This permits the antenna to be made so narrow that it can be accommodated in a thin tubular radome to protect it from atmospheric influences.

BRIEF DESCRIPTION OF THE DRAWING

An embodiment of the invention will now be explained in more detail with reference to the accompanying drawing, which is a top view of an antenna.

DETAILED DESCRIPTION OF THE PREFERRED EMBODIMENT

For the embodiment an antenna has been chosen in which several vertically polarized dipoles are arranged one above the other in the vertical direction as seen in the drawing. With such an antenna, a desired directional pattern can be achieved in the vertical direction if a suitable complex current distribution is chosen.

On a dielectric substrate 1 made of PTFE (polytetrafluoroethylene), copper conductors are deposited in the known manner (e.g., by photoetching techniques). These copper conductors form the dipoles 2, 3 to $\mathbf{2}^{(n)}$, $\mathbf{3}^{(n)}$ of the antenna, the feed system 4, 4', 5, 6, 7, 7', 9 and 12 for the dipoles, and a parasitic compensating radiator 11. The feed system is formed on both sides of the substrate using symmetrical stripline techniques. The copper conductors are not drawn to scale.

A dipole consists, in the manner known per se, of two halves 2, 3, one of which, 2, is located on the top side of the substrate, while the other half, 3, is on the bottom side. The dipoles are suitably shaped in a manner known per se to achieve a broad bandwidth.

The conductors for the feed system feed the RF power to the dipoles at the dipole centers.

The parasitic currents on the conductors of the feed system deform the radiation pattern of the dipoles in such a way that it is no longer circular in the azimuth plane. In the novel antenna, this disturbing influence is advantageously compensated for to a large extent by a parasitic compensating radiator 11.

This compensating radiator 11, too, is realized as a conductor on the substrate. It is possible to provide a vertical conductor on only one side or on both sides of the substrate 1. The conductor may also be replaced with several conductor lengths. What is important is that the dipoles—viewed in the horizontal direction—should be arranged between the conductors of the feed system and the parasitic compensating radiator. In the embodiment, the length of the parasitic compensating radiator is equal to the maximum extent of the conductors of the feed system in the vertical direction.

In the following it will be explained how the individual dipoles are connected via the conductors of the feed system to the RF source (not shown) to obtain a given current distribution and fixed phase relationships.

First a comparison with prior art solutions. In the "Radar Handbook" by M. I. Skolnik, McGraw-Hill Book Company, New York, 1970, pages 11-52 and 11-53 show a few ways to obtain the desired phase relationships. A distinction is made between series feeds and parallel feeds.

With series feeds, a large bandwidth is obtained only if a "series feed with equal line lengths" is chosen. However, this solution requires considerable space. The same applies to purely parallel feeds. In the novel feed system, the "parallel feed" solution and the "equal line length series feed" solution are combined. Surprisingly it was found that such a combination greatly reduces the space requirement. In the embodiment, the RF energy is supplied over the conductor 12. The conductor 12 has three serial junctions a, b, and c. The junctions and the widths of the conductors in front of and behind the junctions (T junctions with $\lambda/4$ transformers) are chosen so that each of the dipoles (or groups of dipoles) receives that portion of the RF energy which is necessary to obtain the desired current distribution.

From the junction a, a conductor 9 runs to a further junction e, from which the two lower dipoles $\mathbf{2}^{(n)}$, $\mathbf{3}^{(n)}$ and $\mathbf{2}^{(IV)}$, $\mathbf{3}^{(IV)}$ are fed in parallel via conductors 7, 7'. From the junctions b and c, the two central dipoles $\mathbf{2}^{(II)}$, $\mathbf{3}^{(II)}$ and $\mathbf{2}^{(III)}$, $\mathbf{3}^{(III)}$ are fed direct via conductors 5, 6. The conductor 12 ends at a last junction d, from which the two upper dipoles 2, 3 and $\mathbf{2}^{(I)}$, $\mathbf{3}^{(I)}$ are fed direct and in parallel via conductors 4, 4'.

The geometric lengths of the individual conductors are such that the electrical path lengths from the RF source to all dipoles are equal or, if the radiation pattern is to be raised in the vertical direction, have a given relationship to each other.

We claim:

1. An antenna comprising a substrate extending along a substrate plane;

an array of elongated dipoles provided on said substrate and arranged along an array axis that is substantially parallel to said substrate plane;

means for feeding electric excitation currents to said dipoles, said feeding means being provided on said substrate, extending substantially parallel to said substrate plane at one side of said array axis, and having portions substantially parallel to said array axis; and means for compensating, at least to a large extent, for the influence of the flow of said electric excitation currents through said feeding means on the radiation pattern of said dipole for producing a final radiation pattern that is at least substantially circular in a plane perpendicular to said array axis, including at least one parasitic compensating radiator arranged on said substrate at said substrate plane and at the opposite side of said dipoles from and in substantial parallelism and alignment with said portions of said feeding means.

2. The antenna as defined in claim 1, wherein said dipoles, said feeding means and said parasitic compensating radiator are all constructed as stripline sections.

3. The antenna as defined in claim 1, wherein said array has a predetermined length as considered along said array axis; and wherein said parasitic compensating radiator extends at a transverse spacing from said dipoles along at least a part of said length of said array.

4. The antenna as defined in claim 1, wherein said feeding means includes a plurality of feeding line sections of predetermined lengths leading to said dipoles and arranged in a predetermined combination of both parallel and series relationships with respect to one another in said feeding means.

* * * * *